United States Patent [19]

Mori et al.

[11] Patent Number: 4,985,087

[45] Date of Patent: Jan. 15, 1991

[54] TREATING ZINCIFEROUS METAL SURFACES TO BLACKEN THEM

[75] Inventors: Kazuhiko Mori; Hitoshi Ishii; Toshi Miyawaki, all of Kanagawa, Japan

[73] Assignee: Nihon Parkerizing Co., Ltd., Tokyo, Japan

[21] Appl. No.: 389,071

[22] Filed: Aug. 3, 1989

[51] Int. Cl.[5] ..... C23C 22/60; C23C 22/68; C23C 30/00

[52] U.S. Cl. ..... 148/273; 148/277; 148/284; 106/14.15

[58] Field of Search ..... 148/273, 255, 254, 284, 148/277, 441; 427/406, 438; 106/14.15

[56] References Cited

U.S. PATENT DOCUMENTS

| | | | |
|---|---|---|---|
| 1,638,273 | 8/1927 | Pacz | 148/273 |
| 3,444,007 | 5/1969 | Maurer | 148/273 |
| 3,929,514 | 12/1975 | Houlihan | 148/273 |
| 4,278,477 | 7/1981 | Reinhold | 148/273 |
| 4,381,203 | 4/1983 | Reinhold | 148/273 |
| 4,479,832 | 10/1984 | Hart | 148/273 |

FOREIGN PATENT DOCUMENTS

| | | |
|---|---|---|
| 43-12974 | 6/1943 | Japan . |
| 57-45833 | 9/1962 | Japan . |
| 61-253381 | 11/1986 | Japan . |

*Primary Examiner*—Jay H. Woo
*Assistant Examiner*—Jeremiah F. Durkin, II
*Attorney, Agent, or Firm*—Ernest G. Szoke; Wayne C. Jaeschke; Norvell E. Wisdom, Jr.

[57] ABSTRACT

Zinc and zinc alloy surfaces can be given an effective corrosion inhibiting treatment by contact for less than a minute with an alkaline aqueous solution having a pH not more than 11 and containing at least 0.020 g/L of dissolved nickel ions and sufficient ammonia to give a molar ratio of ammonia to nickel ion of at least 6. If the concentration of nickel ions in the treating solution is at least 1.0 g/L, a durable blackening of the surface is also produced. Both the corrosion resistance and the quality of the blackening can usually be further improved by subsequent conventional phosphate conversion coating.

12 Claims, No Drawings

TREATING ZINCIFEROUS METAL SURFACES TO BLACKEN THEM

FIELD OF THE INVENTION

This invention relates to a treatment method, by contact with a liquid of specific chemical composition, for surfaces consisting predominantly of zinc, including the surfaces of zinc plated or galvanized materials. Such surfaces will be denoted hereinafter simply as "zinc surfaces", which is to be understood as including zinc alloys with electromotive potentials close to that of zinc itself and surfaces in which the zinc or zinc alloy is a coating of any thickness over other materials. Improved corrosion resistance and a durable blackening of the surface can be achieved by the treatment; the corrosion resistance increase is particularly useful for galvanized steel.

STATEMENT OF RELATED ART

Various means are already known for blackening zinc coated materials by chemical treatment. The blackening method disclosed in Japanese Patent Application Laid Open [Kokai] No. 61-253381 [253,381/86] is an example of this art. The blackening treatment solution in this teaching is an acidic aqueous solution, with pH=1.5 to 4, which contains an oxidant, at least 1 g/L copper ion, and also nickel ions at a concentration of 1 to 30 weight % of the concentration of copper ions. This solution is contacted for 1 to 5 seconds, at a solution temperature of 20 to 70 degrees Centigrade, with the zinc surface to be blackened.

The black film or coating formed by the treatment method of the aforesaid example from the prior art has been found by the present applicants to be susceptible to local corrosion under some conditions and to have less adhesiveness than would be desirable for certain types of use. In addition, because the treatment solution is acidic, the treatment tank or container must be made of an acid-resistant material.

Similarly, it is already known that the corrosion resistance of galvanized steel (which is to be understood herein as including steel electroplated with zinc or a zinc alloy) can be improved by bonding nickel and/or nickel compounds to the surface of the galvanized steel by a chemical treatment. As examples in this regard, reference is made to the descriptions in (1) Japanese Patent Publication No. 57-45833 [45,833/82] and (2) Japanese Patent Publication No. 43-12974 [12,974/68]. The components in reference (1) are a chelating agent, such as glycine or the like, and at least one metal selected from the group comprising iron, nickel, cobalt, chromium, antimony, titanium, and manganese. The components in reference (2) are at least one type of metal ion selected from the group comprising silver, magnesium, cadmium, aluminum, tin, titanium, antimony, molybdenum, chromium, cerium, tungsten, manganese, cobalt, iron (III), iron (II), and nickel, as well as a complexing agent in a quantity sufficient for the solubility of the aforesaid metal ions. The teaching of reference (1) does not describe ammonia as a complexing or chelating agent, while the teaching of reference (2) requires an aqueous solution with a pH of at least 11.0.

In each of these references (1) and (2), the treatment solution mainly uses various types of organic chelating agents as the metal complexing agent, and therefore it is difficult to obtain, within a practical time limit, a sufficient quantity of other metal onto a zinc surface to produce a satisfactory increase in corrosion resistance, because chelating agents bind nickel or other types of metal ions used in the solution so strongly that it is difficult to precipitate free metal from these complexes. When treatment is carried out at elevated pH values for long periods of time in order to increase the metal uptake, not only is the adhesion of the protective metal itself poor, but paint or coating adhesion after a subsequent coating operation is also low.

While ammonia, which is not generally regarded as a chelating agent, is cited as a metal complexing agent in the teaching of reference (2), a pH of at least 11.0 is also specified at the same time. This high pH leads to such problems as a poor process control from changes in bath composition that can readily arise from volatilization of the ammonia.

It is known that chromium and aluminum, probably mixed with their oxides, can be deposited on a zinc surface under certain conditions to provide an increase in corrosion resistance. However, these two metals are both electrochemically baser than zinc, and therefore can not be deposited by displacement from mere contact between zinc and a solution containing them; some external driving force such as electrolysis is required. Nickel can also be coated by electroplating to provide some corrosion resistance, but the methods of electrodeposition of nickel now known produce a surface that is not favorable for later conversion coating by conventional phosphating solutions.

It is an object of this invention to provide a corrosion reducing and, if desired, a blackening treatment for zinc surfaces, which does not have the undesirable characteristics of processes of the cited publications.

DESCRIPTION OF THE INVENTION

In this description, except in the operating examples or where expressly indicated to the contrary, all numbers specifying amounts of materials or conditions of reaction or use are to be understood as modified by the term "about".

The present invention includes a treatment method for zinc surfaces, especially for galvanized steel surfaces, wherein these surfaces are contacted with a treating liquid that is an aqueous alkaline solution having a pH between 7.0 and 11.0 and containing at least 0.020 gram per liter (g/L) of $Ni^{2+}$ ions and sufficient ammonia to provide a molar ratio of ammonia to $Ni^{2+}$ of at least 6. Some counter ion(s) for the nickel are naturally required; any anions that are not strong complexing agents are suitable for use according to the invention, but for simplicity and low cost such ions as chloride and sulfate are preferred.

By means of this treatment, the zinc surface is not usually completely coated with nickel, but instead very small particles of nickel, mixed with some nickel oxides, are adherently deposited on the zinc surface, with little or no dissolution of the zinc. This results in the efficient deposition of a quantity of adhered nickel that itself provides considerable corrosion protection to the underlying zinc. In addition, the surface formed is well suited to a subsequent conventional phosphating conversion coating, and a zinc surfaced object with the conversion coat thus formed has better corrosion resistance than one with a conversion coating formed on the same type of zinc surface, without the intervening treatment according to this invention. The corrosion resistance after phosphating is also better than before phosphating the surface treated by contact with only the alkaline ammoniacal nickel ion containing treating solution according to this invention.

When the concentration of nickel ions in the treating liquid is at least 1.0 g/L, with other constituents as specified immediately above, the treatment produces on the surface a black film or coating, believed to be composed of strongly adhesive and highly corrosion resistant microparticulate nickel and/or nickel oxide on a zinc surface. Even without a post-treatment, the blackened surface is relatively durable, compared to those produced by the precipitates of, for example, Ni, Cu, Sb, Mo, or the like, from acidic displacement plating treatment baths. As a consequence, post-treatments, such as resin coating, etc., which are necessary with prior chemical treatments in order to increase adhesion of the black coatings formed, are unnecessary with the present invention.

The quality of the blackened surface is not harmed, and often is even further improved, by phosphating conversion coating of the blackened surface subsequent to the blackening treatment, which, as noted above, can greatly improve the corrosion resistance of a treated zinc surface, particularly when the treated surface is of galvanized steel.

When the $Ni^{2+}$ concentration in the treatment solution is less than 0.02 g/L, the speed of nickel deposition on a contacted zinc surface is very slow, and, accordingly, the effect of contact is inadequate within practical time intervals. The effect of too low a molar ratio of ammonia to nickel ion is very similar to that of too little nickel ion.

On the other hand, with concentrations in excess of 100 g/L of $Ni^{2+}$ or 300 g/L of $NH_3$, operating problems can readily develop because of composition variations due to nickel crystallization and/or ammonia volatilization, which makes treatment solutions with such high concentration less desirable. When the pH of the treatment solution reaches or exceeds 11.0, ammonia volatilization becomes substantial, again creating problems because of composition variations and a need for high volumes of ventilating air.

Particularly preferred composition ranges for and $NH_3$ correspond to $Ni^{2+}=5$ to 50 g/L and $NH_3=10$ to 100 g/L.

$NH_3$ should be present in a quantity at least 6 times that of the $Ni^{2+}$ on a molar basis, perhaps because six ammonia ligands are coordinated around each nickel ion in the structure of the nickel-ammonia complex. Preferably, the amount of ammonia should be such as to give a molar ratio to nickel ion of at least 15.

When the amount of ammonia needed to give the desired ratio between nickel ion and ammonia is so high that it would make the pH of the solution higher than 11, an acid should be added to the composition in sufficient quantity to convert some of the ammonia to an ammonium salt and reduce the pH to the desired level, which is always below 11. Alternatively, when it is known in advance that a pH that is higher than desired would result from using free ammonia in sufficient quantity to give the desired ratio between ammonia and nickel ion, ammonium salts may be used initially as part of the ammonia content. In either case, ammonium ion in the treating liquid is counted as its stoichiometric equivalent of ammonia in calculating the ratios between ammonia and nickel ions referred to above.

Treatment according to the present invention is preferably, for simplicity, carried out by immersion, dipping, spray, or other processes that simply establish contact between the zinc surface to be treated and the treating solution, but treatment by electrolytic methods is also suitable. With regard to the treatment temperature, treatment can be preferably implemented at treatment temperatures from room temperature to 50 degrees Centigrade.

The practice of the invention can be further appreciated from the following non-limiting operating examples.

EXAMPLES

Examples 1 through 9 and Comparison Examples 1 through 4 were conducted under the treatment conditions shown in Table 1. With the exception of Comparison Example 3, contact between the zinc surface and the treating liquid was carried out by immersion at 40 degrees Centigrade in each case. $Ni^{2+}$ was added in the form of nickel sulfate when the pH regulator was sulfuric acid and in the form of nickel chloride when the pH regulator was hydrochloric acid. $NH_3$ was added in the form of 28% aqueous ammonia. Ammonium sulfate and ammonium chloride were used when needed as noted above.

For the evaluation of corrosion resistance, sheets phosphated conventionally but not treated according to the invention and sheets treated according to Table 1 were cathodically electrodeposition coated to a film thickness of 20 microns, using ELECRON 9410 from Kansai Paint Kabushiki Kaisha. A cut in the form of a cross was made on the coated sheets, sufficiently deep to expose bare base metal. After 1,000 hours of salt-spray testing, the maximum blister width from one side of the cut was measured, and these results are reported in Table 2.

The treatments of Examples 10 through 15 were performed using the treatment solutions, each with a pH of 9.5, and the contact times shown in Table 3. All treatments were carried out by dipping the zinc surfaces into the treatment solution at a temperature of 40 degrees Centigrade. The sources of the $Ni^{2+}$ ions and the ammonia were the same as for Table 1, and ammonium sulfate and ammonium chloride were again added as needed to regulate the pH. With regard to the base materials, i.e., the particular type of zinc surface treated in each example, the letter A designates a zinc-electroplated material and the letter B designates material electroplated with a zinc-nickel alloy. The operating conditions for comparison examples 5-6 were as set forth below.

TABLE 1

| | TREATMENT CONDITIONS | | | | | | |
|---|---|---|---|---|---|---|---|
| | Surface Treated | Concentrations | | pH Regulator | pH | Treatment Time | Phosphate Post-Treat* |
| Example 1 | EG | $Ni^{2+}$ | 10 g/L | $H_2SO_4$ | 9.5 | 20 sec. | yes |
| | | $NH_3$ | 50 g/L | | | | |
| Example 2 | HD | $Ni^{2+}$ | 20 g/L | $H_2SO_4$ | 10.0 | 30 sec. | yes |

TABLE 1-continued

| TREATMENT CONDITIONS | | | | | | | |
|---|---|---|---|---|---|---|---|
| | Surface Treated | Concentrations | | pH Regulator | pH | Treatment Time | Phosphate Post-Treat* |
| Example 3 | EG | $NH_3$<br>$Ni^{2+}$ | 70 g/L<br>10 g/L | HCl | 9.5 | 20 sec. | yes |
| Example 4 | EG | $NH_3$<br>$Ni^{2+}$ | 50 g/L<br>2.0 g/L | $H_2SO_4$ | 9.0 | 30 sec. | yes |
| Example 5 | EG | $NH_3$<br>$Ni^{2+}$ | 10 g/L<br>80 g/L | $H_2SO_4$ | 8.0 | 10 sec. | yes |
| Example 6 | EG | $NH_3$<br>$Ni^{2+}$ | 300 g/L<br>20 g/L | $H_2SO_4$ | 8.0 | 10 sec. | yes |
| Example 7 | EG | $NH_3$<br>$Ni^{2+}$ | 40 g/L<br>100 ppm | $H_2SO_4$ | 9.0 | 60 sec. | yes |
| Example 8 | EG | $NH_3$<br>$Ni^{2+}$ | 10 g/L<br>30 ppm | $H_2SO_4$ | 9.0 | 60 sec. | yes |
| Example 9 | EG | $NH_3$<br>$Ni^{2+}$ | 10 g/L<br>10 g/L | $H_2SO_4$ | 9.5 | 20 sec. | no |
| Comparison Example 1 | EG | $NH_3$<br>$Ni^{2+}$ | 50 g/L<br>15 ppm | $H_2SO_4$ | 9.0 | 60 sec. | yes |
| Comparison Example 2 | EG | $NH_3$<br>$Ni^{2+}$ | 5.0 g/L<br>100 ppm | $H_2SO_4$ | 2.0 | 20 sec. | yes |
| Comparison Example 3 | EG | $Ni^{2+}$<br>glycine | .76 g/L<br>9.0 g/L | NaTPP 5 g/L +NaOH | 8.6 | 30 sec. (25° C.) | yes |
| Comparison Example 4 | EG | $Co^{2+}$<br>Na gluconate | 2.0 g/L<br>2.0 g/L | NaOH (ca. 30 g/L) | 14.0 | 10 sec. | no |

*PB-L 3020 from Nihon Parkerizing Company, Limited
NaTPP = sodium tripolyphosphate;
EG = electrogalvanized steel (20 grams zinc per $m^2$);
HD = hot dipped galvanized steel (90 g/$m^2$ zinc).
Comparison Example 3 is according to the directions of Japanese Pat. Pub. No. 57-45833, and Comparison Example 4 is according to the directions of Japanese Pat. Pub. No. 43-12974

TABLE 2

| PERFORMANCE EVALUATION<br>Maximum Blister Width in Millimeters | |
|---|---|
| Example 1 | 2.0 |
| Example 2 | 0.5 |
| Example 3 | 2.0 |
| Example 4 | 3.5 |
| Example 5 | 2.5 |
| Example 6 | 3.5 |
| Example 7 | 5.5 |
| Example 8 | 6.0 |
| Example 9 | 3.5 |
| Comparison Example 1 | 7.5 |
| Comparison Example 2 | 7.0 |
| Comparison Example 3 | 6.5 |
| Comparison Example 4 | 9.5 |
| Untreated EG Sheet | 7.5 |
| Untreated HD Sheet | 2.0 |

COMPARISON EXAMPLE 5

| Treatment conditions | |
|---|---|
| Components: | 10 g/L of $Cu^{2+}$<br>1.5 g/L of $Ni^{2+}$<br>20 g/L of potassium chlorate |
| pH: | 3.0 |
| Temperature: | 30 degrees Centigrade |
| Treatment time: | 2 seconds |

(This is the treatment method as described in Japanese Patent Application Laid Open No. 61-253381)

Base material (A)

TABLE 3

| SOLUTION COMPOSITIONS AND TREATMENT TIMES, EXAMPLES 10–15 | | | | | |
|---|---|---|---|---|---|
| Example No. | Material Treated | Concentrations of Main Components | | Regulator for pH | Contact Time |
| 10 | A | $Ni^{2+}$<br>$NH_3$ | 10 g/L<br>60 g/L | $H_2SO_4$ | 15 sec |
| 11 | B | $Ni^{2+}$<br>$NH_3$ | 20 g/L<br>100 g/L | $H_2SO_4$ | 20 sec |
| 12 | A | $Ni^{2+}$<br>$NH_3$ | 10 g/L<br>60 g/L | HCl | 15 sec |
| 13 | A | $Ni^{2+}$<br>$NH_3$ | 2.0 g/L<br>10 g/L | $H_2SO_4$ | 20 sec |
| 14 | A | $Ni^{2+}$<br>$NH_3$ | 80 g/L<br>150 g/L | $H_2SO_4$ | 20 sec |
| 15 | A | $Ni^{2+}$<br>$NH_3$ | 5 g/L<br>30 g/L | $H_2SO_4$ | 20 sec |

COMPARISON EXAMPLE 6

| Treatment conditions | |
|---|---|
| Components: | 2.0 g/L of $Ni^{2+}$<br>5.0 g/L of sodium gluconate |
| pH regulator: | NaOH |
| pH: | 11.5 |
| Temperature: | 40 degrees Centigrade |
| Treatment time: | 20 seconds |
| Base material: | A |

The blackness was evaluated by the L-value as measured using an SM Color Computer (from Suga Shikenki Kabushiki Kaisha), with a lower value indicating darker blackness. The adhesion was evaluated based on exfoliation or peeling by adhesive tape on the bent curve after bending a sample to double its thickness (a "1 T" bend). These results are reported in Table 4.

As explained above, through use of treatment solutions according to the present invention, a remarkable improvement in resistance to paint blistering in moist corrosive environments, which tends to be a problem for galvanized steel sheet, is obtained. These treatment solutions are different from those heretofore employed in nickel-bonding treatment processes, and the solutions as taught herein can produce surface-treated galvanized steel plate which evidences an excellent conversion treatability and an excellent corrosion resistance after coating. The contact time required between the treatment liquids according to the invention and the zinc surface is usually not more than 60 seconds and can be at least as short as 10 seconds.

These advantages impart an excellent added value, especially to relatively inexpensive galvanized steel sheet, and in particular result in a high quality treatment for plated and coated steel sheet for automotive applications, where a high corrosion resistance and good receptivity to protective organic surface coatings are required.

Moreover, the method of the present invention consists of a treatment with a simple liquid composition, thus offering advantages from the standpoints of treatment composition management, workability, processability, costs, and the like, including lack of need for electrolysis and use of a mildly alkaline, rather than an acid, treating composition, thus reducing the limitations and restrictions on the use and waste disposal of the composition.

Additionally, the treatment method of the present invention, in contrast to prior chemical treatment methods, produces a highly corrosion resistant and strongly adherent blackening by a single-step treatment. Further, by subjecting aluminum and other metal surfaces to a zinc-plating pretreatment, they can also be blackened using the present invention.

TABLE 4

BLACKNESS EVALUATION, EXAMPLES 10–15 AND COMPARISON EXAMPLES 5–6

| Identification | Blackness (L-value) | Adhesion |
|---|---|---|
| Example 10 | 16 | +++ |
| Example 11 | 15 | +++ |
| Example 12 | 16 | +++ |
| Example 13 | 20 | +++ |
| Example 14 | 14 | +++ |

TABLE 4-continued

BLACKNESS EVALUATION, EXAMPLES 10–15 AND COMPARISON EXAMPLES 5–6

| Identification | Blackness (L-value) | Adhesion |
|---|---|---|
| Example 15 | 17 | +++ |
| Comparison Example 5 | 12 | X |
| Comparison Example 6 | 40 | +++ |

The evaluation scale for adhesion was as follows:
+++: no peeling
++: less than 10% peeling
+: 10 to 30% peeling
X: more than 30% peeling

What is claimed is:

1. A process for treating a zinc surface, comprising contacting the zinc surface, for a time sufficient to blacken the surface with a treating liquid that is an alkaline aqueous solution which has a pH between about 7 and about 11.0 and consists essentially of at least about 1.0 g/L of $Ni^{2+}$ ions and sufficient $NH_3$ to give a molar ratio of $NH_3$ to $Ni^{2+}$ ions in the treating solution of at least about 6.

2. A process according to claim 1, wherein the treating liquid contains at least about 5 and not more than about 50 g/L of nickel ions and at least 10 but not more than 100 g/L of ammonia.

3. A process according to claim 2, wherein the molar ratio of $NH_3$ to $Ni^{2+}$ ions in the treating liquid is at least about 15.

4. A process according to claim 1, wherein the molar ratio of $NH_3$ to $Ni^{2+}$ ions in the treating liquid is at least about 15.

5. A process according to claim 4, wherein the temperature of the treating liquid during contacting is between about 20° and about 50° C.

6. A process according to claim 3, wherein the temperature of the treating liquid during contacting is between about 20° and about 50° C.

7. A process according to claim 2, wherein the temperature of the treating liquid during contacting is between about 20° and about 50° C.

8. A process according to claim 1, wherein the temperature of the treating liquid during contacting is between about 20° and about 50° C.

9. A process according to claim 8, wherein the time of contacting is not more than about 60 seconds.

10. A process according to claim 7, wherein the time of contacting is not more than about 60 seconds.

11. A process according to claim 6, wherein the time of contacting is not more than about 60 seconds.

12. A process according to claim 5, wherein the time of contacting is not more than about 60 seconds.

* * * * *